United States Patent [19]

Nava

[11] Patent Number: 4,581,775

[45] Date of Patent: Apr. 15, 1986

[54] TILTING VIZOR FOR HELMETS PARTICULARLY FOR SPORTS USE

[76] Inventor: Pier L. Nava, Via Carnovali 1/A, Bergamo, Italy

[21] Appl. No.: 539,824

[22] Filed: Oct. 7, 1983

[51] Int. Cl.[4] ..... A42B 1/08

[52] U.S. Cl. ..... 2/424; 2/5; 2/6; 2/427

[58] Field of Search ..... 2/424, 15, 427, 425, 2/5, 6

[56] References Cited

U.S. PATENT DOCUMENTS

| | | | |
|---|---|---|---|
| 3,585,638 | 6/1971 | Aileo | 2/6 |
| 3,721,994 | 3/1973 | De Simone et al. | 2/6 |
| 4,047,249 | 9/1977 | Booth | 2/424 |
| 4,141,085 | 2/1979 | Adams | 2/424 |
| 4,223,410 | 9/1980 | Nava | 2/424 |
| 4,305,160 | 12/1981 | Sundahl | 2/424 |
| 4,312,078 | 1/1982 | Pollitt et al. | 2/424 |

FOREIGN PATENT DOCUMENTS

| | | | |
|---|---|---|---|
| 2338005 | 4/1976 | France | 2/424 |
| 2326156 | 4/1977 | France | 2/424 |
| 7611248 | 3/1977 | Netherlands | 2/424 |

OTHER PUBLICATIONS

PCT WO82/00243, 2/1982, Klein.

*Primary Examiner*—Werner H. Schroeder
*Assistant Examiner*—Mary A. Ellis
*Attorney, Agent, or Firm*—Ladas & Parry

[57] ABSTRACT

A protective helmet, vizor combination includes the helmet having a front portion, a rear portion and a pivoting pin extending outwardly from the front portion. The vizor of this combination is attached to the front portion of the helmet for pivotable movement about the pivot between an open and closed position of the vizor. The vizor has a slot going through a thickness of the vizor. This slot has stop portions located on opposite sides thereof. The bottom extends from the front portion of the helmet and through the slot means of the vizor. This bottom has an elastic outside portion with the groove. The groove is adapted for engagement with the slot of the vizor.

10 Claims, 5 Drawing Figures

TILTING VIZOR FOR HELMETS PARTICULARLY FOR SPORTS USE

This invention relates to a tilting vizor for helmets in particular helmets for sportsmen, such as motorcyclist, skiers etc.

The known types of helmets have their edge lowered to house the tilting vizor which therefore fits end to end and hence is not uplifted outwardly from the helmet's external surface.

These helmets had many drawbacks and limitations especially in regard to internal ventilation which must be adequately controlled to avoid excessive cooling on the one hand fogging of the vizor on the other.

The present invention obviates these drawbacks and enables internal ventilation of the helmet in the measure required and in a simple rational manner even when the vizor is lowered and the wearer cannot use both hands, as in the case of motorcyclists and similar users.

The vizor according to the invention is an improvement of that described in U.S. Pat. No. 4,223,410 by the same inventor. Said vizor the edge of which is housed in a peripheral ledge in the opening of the helmet and the hinges of which are associated with locking devices yieldably connected to each other to maintain the vizor in closed position, is characterized by a shaped slot in which is slidably engaged one of the two elements of the locking means, retained by the helmet and vizor to consent a controlled lifting of at least a part of the lower edge of the vizor and to form thus an opening apt to determine passage of a laminar air layer which avoids fogging of the vizor by striking at least a part of the internal surface of same.

To provide the air laminating opening according to the invention the shaped lateral slots on the vizor are provided with yieldable restrictions suitably spaced from each other, which engage pins or similar means secured to one of the elements constituting the parts that lock the vizor to the helmet; said parts consist, advantageously of elastic buttons as already considered in another patent by the same inventor; the buttons facilitate lifting of the vizor from the helmet's opening.

To ensure a rational internal ventilation of the helmet also when the vizor is lowered, the vizor according to this invention is provided at one of its ends with apertures; said apertures place the interior of the helmet in communication with the exterior through suitably shaped baffles which provide an ejection effect when the wearer moves with repect to the ambient, thereby creating a negative pressure inside the helmet itself.

Advantageously, the baffles, combined with the apertures of the helmet are provided on the vizor; this facilitates the realization and in particular the shaping of said baffles in relation to the ejection effect to be achieved.

For this purpose the outer apertures of the baffles may be adjustable in a position such that the wind will produce the desired ejection at said apertures.

The invention will now be described in conjunction with the annexed drawings which illustrate, by way of example, a helmet of the type considered, provided with a preferred form of embodiment of the vizor. Specifically:

FIG. 1 is a partial cross sectional view, in side elevation of the vizor according to the invention, in the closed position.

FIG. 2, similar to FIG. 1 shows the vizor in the partially lifted position FIG. 3 is a cross section on a larger scale taken on lines III—III of FIG. 2.

The vizor illustrated corresponds to that considered in utility model patent No. 22775 BE/77 by the same author in which parts corresponding to that of said patent are designated by the same reference symbols.

Figure 1:
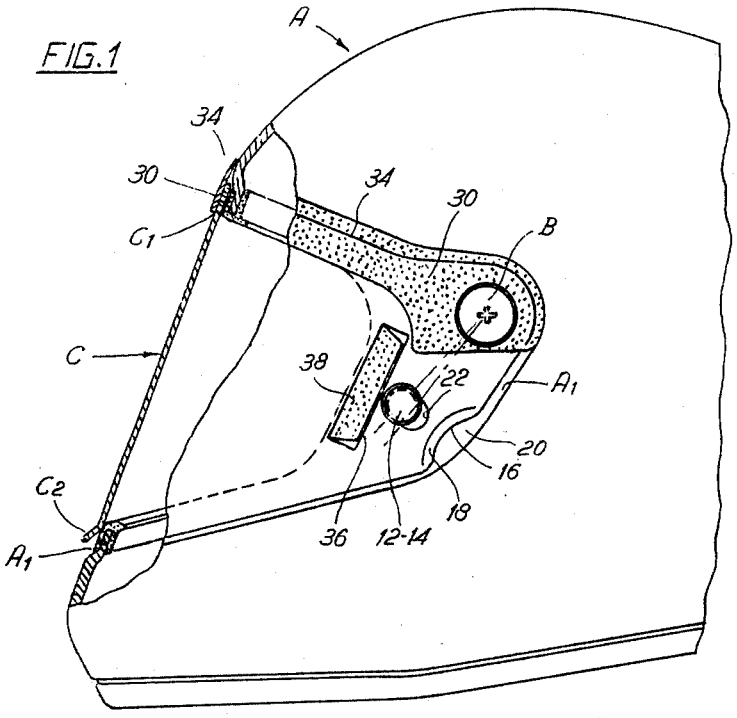
Figure 3:
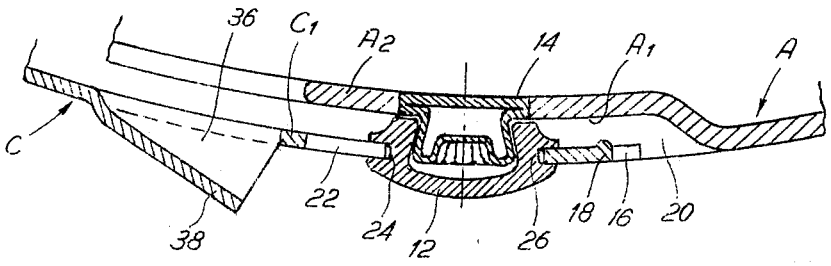
Figure 4:
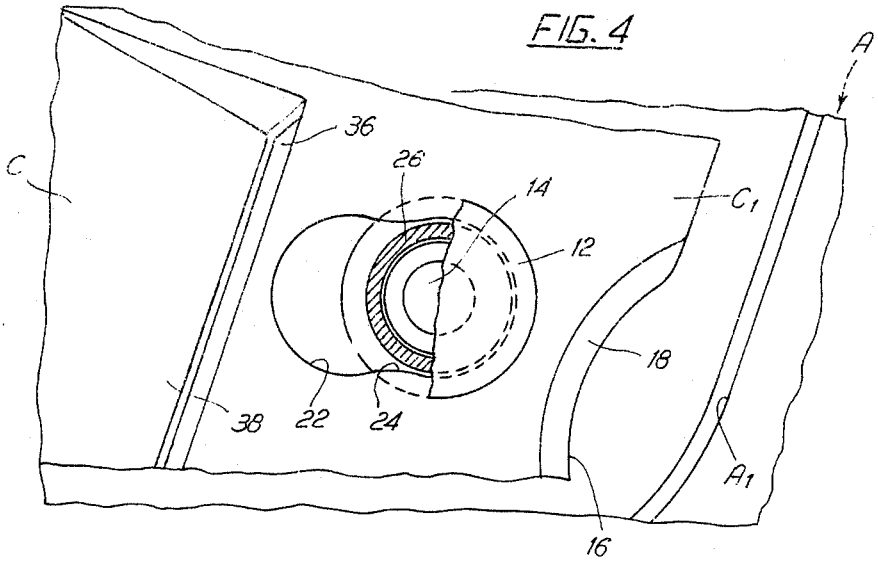
FIG. 4, is a horizontal substantially co-plannar cross section of the vizor.
Figure 5:
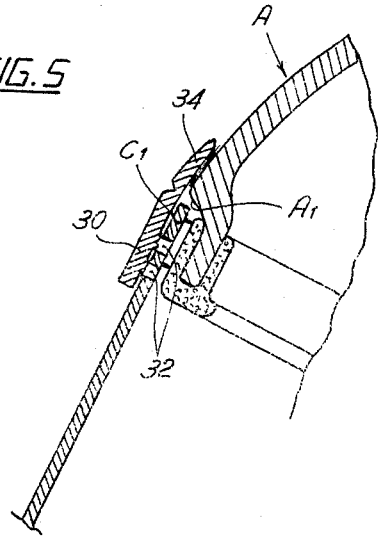
FIG. 5 is a detail in cross section of the top edge of the vizor

Specifically, letter A designates the helmet and letter B the pin which retains vizor C, edge $C_1^2$ of which is housed in peripheral ledge $A_1$ of the opening of the helmet. Vizor C is retained on the lateral walls of helmet A by pins B and may be locked in its lowered position, or closed, (FIG. 1) by locking means 12–14 located at the ends of vizor C; each one of said locking means consists of a usual elastic button, the external elements 12 and internal elements 14 of which (see FIG. 3) may be coupled and which are retained respectively by vizor C and helmet A as will now be described.

According to the invention, element 12 of locking element 12–14 is secured to vizor C through a shaped slot 22 provided with opposite restrictions 24 to form, its rounded ends, two stops for external element 12 and which engages a groove 26 provided in the periphery of said element 12.

Precisely, the length of slot 22 is such as to permit moving away the lower edge $C_2$ of vizor C from ledge $A_1$ of the helmet to form an opening D which extends practically over the entire length of the opening of the helmet.

The width of opening D is, obviously determined by the length of shaped slot 22 in the end of vizor C when the latter is disengaged from ledge $A_1$ of the helmet. This operation is enabled not only by notches 18 provided in the ends of vizor C (which in practice also serve to separate elements 12 and 14 of locking means 12–14 form each other) but also by a fold provided at least a part of lower edge $C_2$ of said vizor C.

Figure 2:
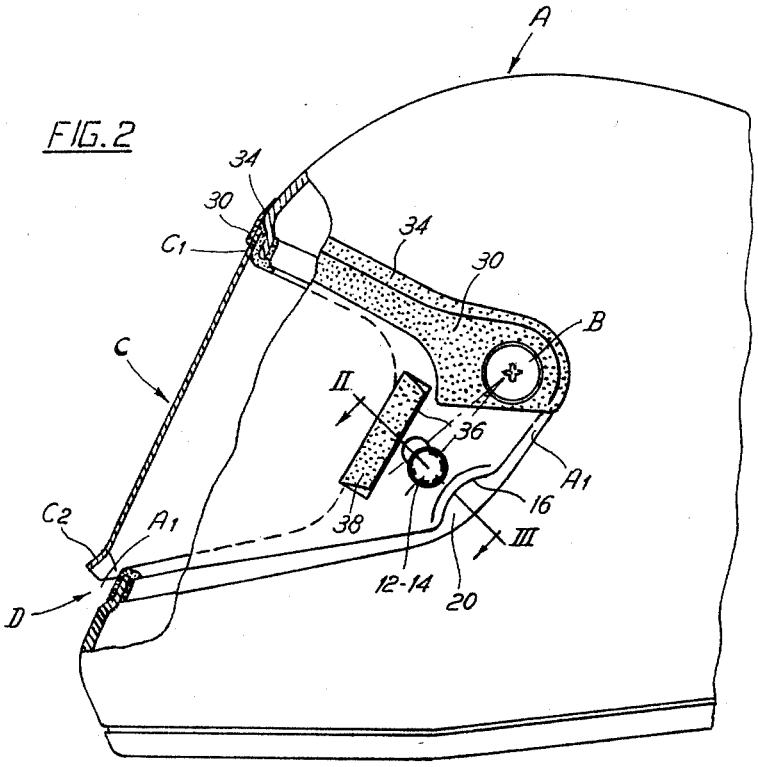

In order to ensure tightness between the top edge of the vizor when this is partially or totally lifted (FIG. 2) top edge $C_1$ is provided with a shaped list 30 firmly secured to the outer surface of the vizor to form a screen and also to improve appearance.

The list is secured to top edge C1 of the vizor by adhesives and positioned by projections or similar on the listel itself which engage with corresponding holes provided in said edge $C_1$.

The top edge of list 30 has an elastic portion fin 34 which adheres to the outer surface of helmet A even when vizor C is lifted partially to avoid the entry of water or other matter into the interior of the helmet the elastic fin 34 is provided in the edge of shaped listel 30 secured to the top longitudinal zone $C_1$ of the visor C and is positioned by protrusions 32 which engage in the holes provided in the visor.

In order to ensure air circulation inside the helmet, even when vizor C is lowered, the vizor is provided with apertures 36 combined with suitable baffles 38 (see FIG. 3) toward its ends, which convey the air blade (created by opening D inside the helmet) toward the exterior, in relation to the effect of ejection determined by the position and shape of said baffles 38.

The removal of air from the interior of the helmet is thus achieved, even if in limited measure, also when vizor B is lowered (FIG. 1) and this in relation to the lower opening of the helmet.

To achieve the desired effect of air ejection baffles 38 must be shaped conveniently so that the wind formed between the helmet worn by the user in movement and the ambient strikes said baffles continuously to create a negative pressure at the apertures of the latter which draws the air from the interior of the helmet.

For the above purpose the baffles are produced as independent parts and applied subsequently to apertures 36 of the vizor in a suitable manner, for example by means of of adhesives.

Moreover, baffles 38 are secured on the openings 36 of the vizor by joints formed, for example by a slot and tongue. To regulate the air ejection action produced by baffles 38, apertures 36 may be combined with slotted slidable plates to regulate the flow sections of said openings.

Furthermore the apertures in baffles 38 which lead to the exterior may be suitably directed to regulate the ejection effect produced by the wind which strikes said baffles. For example, the baffles may rotate about an axis substantially parallel to the hinging axis of the vizor to the helmet (pins B).

It is evident that the complete lifting of vizor C is achieved by disengaging external elements 12 from internal elements 14 of locking means 12–14 or elastic buttons. Further, at least part of a lower edge of the visor is folded upwards to form a hooking element used to disengage the visor from a peripheral ledge of the helmet. In order to facilitate the lifting of the visor notches 16 are provided on side portions thereof (see FIG. 1 and FIG. 2). These notches have edges 18 and are adapted to accommodate the fingers of the user during the process of the lifting.

On the other hand when said elements of the locking means are engaged with each other, vizor C can be lifted limitedly in relation to the length of shaped slots 22 to form thus the aerating aperture D; this aperture creates an air blade which strikes the inner surface of vizor C, thereby to avoid fogging of the latter, whilst internal ventilation of the helmet is improved.

Obviously each one shaped slots 22 may have more than two openings, interspaced by restrictions 24 which elastically exert a braking action on the movement of the vizor when they engage with the bottom parts of annular slots 26 in side elements 12 of locking means or elastic buttons 22–14.

The elastic action between restrictions 24 and annular slots 26 of buttons 12–14 may be increased by providing at least one of the two zones which delimit the restrictions with incisions or fissures. The visor has an elastic outside portion separated from the inside portion of the button means which is lifted substantially upwardly so that a substantial part of the opening of the front part and the face of the wearer are opened to outside air.

The objects of the invention are thus confirmed, in particular the possibility to adjust the width of aperture D to regulate internal ventilation of the helmet and avoid stagnation of air inside same.

Other modifications in addition to those considered may be introduced in the vizor described, especially as regards the helmet to which the vizor is applied.

For example, the restrictions of shaped slots 22 may be cap shaped to position vizor B by snap action in the opening and closed positions; the parts may also be sprung by providing their adjacent zones with shaped fissures to render said caps elastically yieldable.

It is understood that the present protection also extends to the helmet, the vizor of which incorporates one or more of the features above considered and which are defined by the claims which follow.

In practice, the details of embodiment of the vizor may vary, but without departing from the domain or spirit of the invention.

I claim:

1. A protective helmet, visor combination, comprising:

the helmet having having a front portion with an opening, a rear portion and pivoting means extending outwardly from said front position;

the visor being attached to the front portion of said helmet for pivotable movement about said pivoting means between an open and closed position of the visor, said visor having slot means going through a thickness of the visor, said slot means having stop portion for engagement with button means;

said button means extending from said front portion of the helmet through said slot means of the visor.

2. A combination according to claim 1 wherein said apertures in the visor and in baffles are combined with said apertures provided with an arrangement for pivoting of the visor.

3. A combination according to claim 1 wherein the baffles are produced as elements separate from the visor and applied conveniently at apertures of said visor to enable easy and convenient shaping of said baffles to obtain a satisfactory air ejection action.

4. A combination according to claim 3 wherein the apertures of baffle are adjustable outwardly to control aeration.

5. A combination according to claim 1 wherein at least part of a lower edge of the visor is folded upwards to form a hooking element used to disengage the visor from a peripheral ledge of the helmet.

6. A combination according to claim 1 wherein a top edge portion of the visor is connected to an outer surface of the front portion of the helmet by a list.

7. A combination according to claim 6 wherein said list has an elastic portion extending upwardly form the top edge of the visor.

8. A combination according to claim 7 wherein a position of the list attached to the visor has protrusions for permanent engagement with openings provided on the visor and the elastic portion of the list is fixedly attached to the outside surface of the helmet, whereby tight and flexible connection between the visor and the helmet is provided.

9. A combination according to claim 1 wherein said elastic outside portion of said button means being engaged with said visor can be separated from said inside portion of said button means.

10. A combination according to claim 9 wherein said visor having said elastic outside portion being separated from said inside portion of said button means is lifted substantially upwardly so that a substantial portion of said opening of said front portion and a face of the wearer are opened to an outside air.

* * * * *